US011319129B2

(12) United States Patent
Olsen

(10) Patent No.: US 11,319,129 B2
(45) Date of Patent: May 3, 2022

(54) FLEXIBLE CONTAINER CARRIER

(71) Applicant: ILLINOIS TOOL WORKS INC., Glenview, IL (US)

(72) Inventor: Robert C. Olsen, Medinah, IL (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 0 days.

(21) Appl. No.: 17/049,204

(22) PCT Filed: May 14, 2019

(86) PCT No.: PCT/US2019/032204
§ 371 (c)(1),
(2) Date: Oct. 20, 2020

(87) PCT Pub. No.: WO2019/222205
PCT Pub. Date: Nov. 21, 2019

(65) Prior Publication Data

US 2021/0237955 A1 Aug. 5, 2021

Related U.S. Application Data

(60) Provisional application No. 62/671,055, filed on May 14, 2018.

(51) Int. Cl.
*B65D 71/50* (2006.01)

(52) U.S. Cl.
CPC .. *B65D 71/504* (2013.01); *B65D 2571/00277* (2013.01)

(58) Field of Classification Search
CPC ..... B65D 71/50; B65D 71/504; B65D 75/00; B65D 2571/00277; B65D 23/10; B65D 23/102
USPC ..... 206/150, 151–153; 294/87.2
See application file for complete search history.

(56) References Cited

U.S. PATENT DOCUMENTS 4,356,914 A * 11/1982 Olsen ..... B65D 71/504 206/150
5,018,620 A * 5/1991 Marco ..... B65D 71/504 206/150
6,125,999 A * 10/2000 Slomski ..... B65D 71/504 206/150
7,445,114 B2 * 11/2008 Olsen ..... B65D 71/504 206/150
7,775,348 B2 * 8/2010 Olsen ..... B65D 71/504 206/150
7,793,778 B2 * 9/2010 Olsen ..... B65D 71/504 206/150

(Continued)

OTHER PUBLICATIONS

European Patent Office (EPO), Rijswijk, NL, Int'l Search Report, Form PCT/ISA/210 for Int'l Application No. PCT/US2019/032204, dated Sep. 4, 2019 (2 pages).

*Primary Examiner* — Bryon P Gehman
(74) *Attorney, Agent, or Firm* — Pauley Erickson & Swanson

(57) ABSTRACT

A flexible container carrier for unitizing a plurality of containers that includes a plurality of flexible bands that form an array of container receiving apertures, the array arranged in longitudinal rows and transverse ranks. A handle is formed along each longitudinal edge of the array of container receiving apertures. Two or more sets of perforations are formed between each row of container receiving apertures and between center apertures.

5 Claims, 1 Drawing Sheet

(56) References Cited

U.S. PATENT DOCUMENTS

| | | | | |
|---|---|---|---|---|
| 9,079,700 | B2 * | 7/2015 | Marco | B65D 23/102 |
| 9,669,977 | B2 * | 6/2017 | Olsen | B65D 23/102 |
| 10,301,092 | B2 * | 5/2019 | Olsen | B65D 71/504 |
| 2007/0193899 | A1 | 8/2007 | Olsen et al. | |
| 2018/0111735 | A1 | 4/2018 | Olsen | |

* cited by examiner

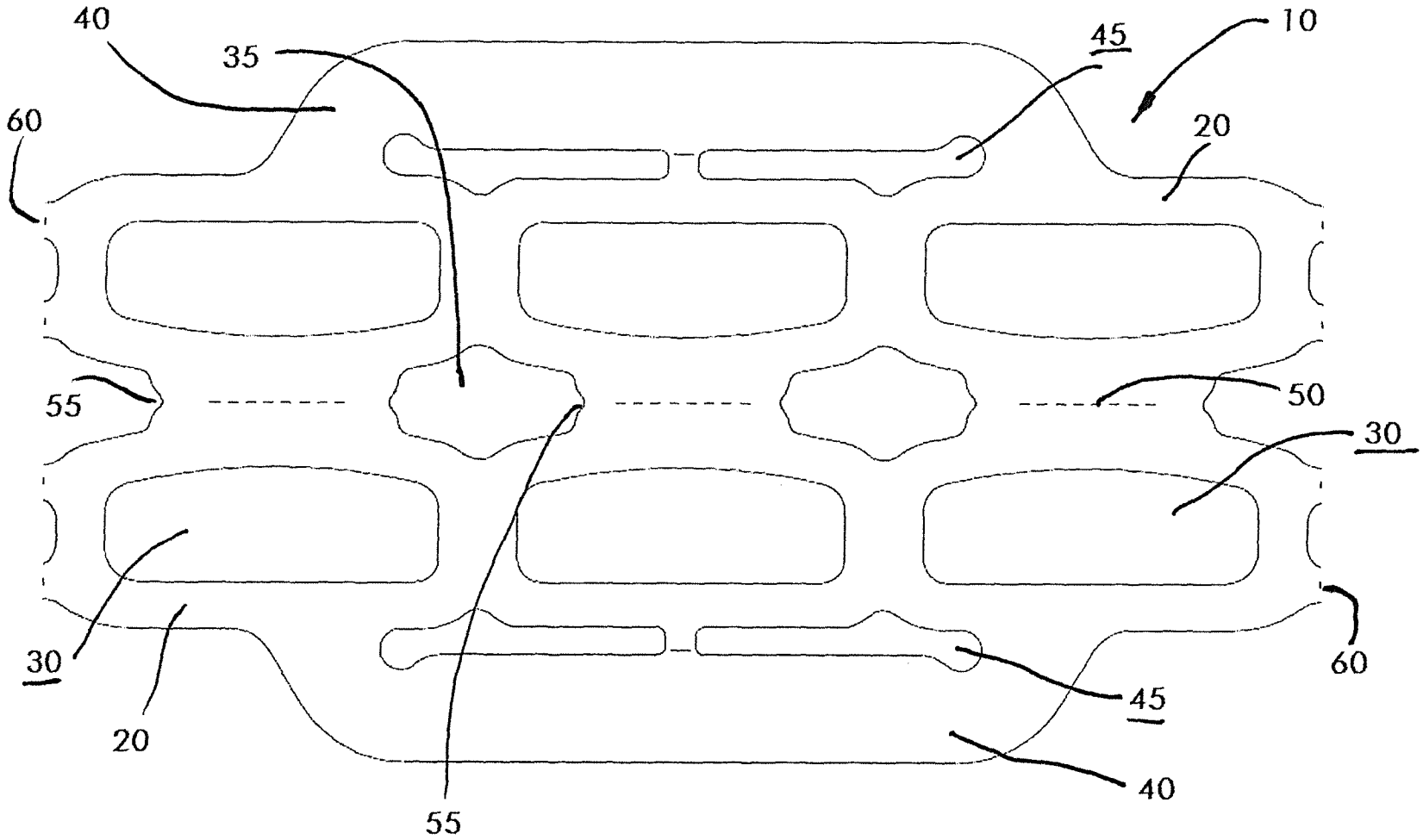
10
20
45
50
30
60
45
40
55
35
40
60
55
30
20

FLEXIBLE CONTAINER CARRIER

FIELD OF THE INVENTION

This invention relates to a container carrier having container receiving apertures for unitizing a plurality of containers.

DESCRIPTION OF PRIOR ART

Conventional container carriers are often used to unitize a plurality of similarly sized containers, such as cans, bottles, jars and boxes and/or similar containers that require unitization. Flexible plastic ring carriers are one such conventional container carrier.

Flexible plastic ring carriers having a plurality of container receiving apertures, typically of an oval, round or rectangular configuration, that each engage a corresponding container may be used to unitize groups of four, six, eight, twelve or other suitable groups of containers into a convenient multipackage. Flexible ring carriers may include a handle that extends outwardly from a side of the carrier to enable a consumer to carry the package from the side (called a "side lift carrier").

A need exists to permit the bottler, the retailer and/or the consumer to adjust a desired size of the multipackage for retail sale, display and/or purchase. As such, a post-production dividable multipackage may be beneficial from a flexibility standpoint for multiple parties. In the past, dividing a package following application of containers to a carrier may jeopardize the integrity of the resulting sub-packages.

SUMMARY OF THE INVENTION

Multipack carriers have been in use for many years—generally in even multiples. The subject carrier permits users to multipackage an odd number for sale by dividing the pack in the center. Handles are also provided along with a center perforation line to make the dividing easier and maintain a dividing line and thereby maintain the integrity of the resulting sub-packages. The present invention is directed to a flexible carrier for packaging containers that includes an arrangement of container receiving apertures that are configured to permit placement over containers and permit carrying a unitized package of containers along a pair of handles, i.e., one handle extending longitudinally along each side of the package.

The container carrier preferably includes an arrangement of container receiving apertures and intermediate cutouts with two side lift handles as shown in the attached drawing and described in more detail herein. The resulting carrier is configured to enable placement over corresponding containers to result in a tight, unitized bricklike package and/or sub-package that is flexible for the retailer and/or the consumer.

BRIEF DESCRIPTION OF THE DRAWINGS

The above-mentioned and other features and objects of this invention will be better understood from the following detailed description taken in conjunction with the drawings wherein:

FIG. 1 is a side elevational view of a container carrier according to one preferred embodiment of this invention.

DESCRIPTION OF PREFERRED EMBODIMENTS

FIG. 1 shows a flexible carrier for unitizing four or more containers into a resulting unitized package. Although FIG. 1 illustrates one structure for the flexible carrier of the invention, the illustration is exemplary, and the invention is not limited to the flexible carrier shown for six containers. For example, the flexible carrier may be alternatively configured and used to unitize four, eight, ten, twelve, or any other desired number of containers into a divisible multipackage capable of splitting in to sub-packages of two, four, five, six or similar numbers of containers.

Containers are preferably cans, however, bottles or any other commonly unitized container may be used with flexible carrier according to this invention. The containers are preferably, though not necessarily, like-sized within a single flexible carrier.

Each flexible carrier 10 preferably includes a single layer of flexible sheet having a width and length defining therein a series of bands 20 that form a plurality of container receiving apertures 30, each for receiving a container. The plurality of container receiving apertures 30 are preferably arranged in two longitudinal rows and multiple longitudinal ranks so as to form an array of container receiving apertures, such as two rows by three ranks for a six container multipackage as shown in FIG. 1. Container receiving apertures are preferably generally slightly elongated in a longitudinal direction of the flexible carrier 10.

As shown in FIG. 1, each container receiving aperture may be generally linear along an outer edge facing outward of the carrier 10 and generally arcuate along an inner edge facing toward a center of the carrier 10.

A representative package (not shown) resulting from the flexible carrier 10 includes a plurality of unitized containers. Flexible carriers 10 are generally applied to containers by stretching the bands 20 surrounding the container receiving apertures 30 around each respective container, and requiring the stretched carrier to recover, thereby providing a tight engagement.

Preferably, the carrier 10 shown in FIG. 1 is manufactured in a generally continuous string of carriers wherein carriers are punched or otherwise formed longitudinally adjacent to other carriers. In this manner, a generally continuous string of carriers is formed that may be rolled onto reels or folded into boxes for later unwinding and application to containers. The carriers are then cut into individual carriers and packages. As shown in FIG. 1, each carrier 10 is connected to each adjacent carrier along bands 20 which are separated with one or more separating perforation 60. More specifically, as shown, each carrier 10 is connected to each adjacent carrier in a generally continuous string at four attachment points, each attachment point having a separation perforation 60 thereby enabling separation of the adjacent carriers 10 following or during application to containers.

The two rows of container receiving apertures 30 are preferably divided by two or more intermediate apertures 35 that are formed between the rows. Each aperture 30, 35 is preferably formed in a geometry that results in a uniform application of the carrier to containers to produce a tight unitization of containers within the flexible carrier 10. Such a result is difficult when material within the flexible carrier is minimized as shown and described herein.

The intermediate apertures 35 are preferably asymmetric about a transverse axis of the carrier 10. More specifically, each intermediate aperture 35 preferably extends longer in a direction toward a center of the carrier 10 as shown in FIG. 1. In this manner, the carrier 10 properly retains containers in a tight and unitized fashion and permits separation of the carrier 10 into sub-carriers forming sub-packages as described below.

The subject carrier is designed in such a way to be applied normally on a conventional jaw applicating machine. Once the 2/4/6/8 multipackage is made, it can be slit or otherwise divided down the center thus giving a different multipack equaling half of the original pack. Specially designed perforations 50 are preferably included in the carrier 10 to make the separation easier and additionally help to keep the slitting blade on line. Also the center band 20 of the carrier 10 is significantly wider than outer bands 20 thus allowing a blade or blade assembly to have minimal resistance when slicing. The center band 20 may be approximately twice as wide as the outer bands 20.

In addition, a lead-in or notch 55 may be formed at each distal end of each center aperture 35. The notch 55 is provided within the center apertures 35 between the parallel rows of container receiving apertures 30 to assist the blade to locate the center web 20 exactly where it is to be cut.

The resulting division of the multipackage into subpackages may be accomplished at the production facility with an in-line knife assembly or alternatively may be performed by a retailer or even a consumer. According to one preferred embodiment, the division may be accomplished without mechanical assistance by simply pulling the multipackage apart.

Handles 40 are preferably provided on either side of the carrier 10 to make carrying easier and more convenient. As shown in FIG. 1, a handle 40 extends from each longitudinal edge of the carrier 10. The handle 40 may include one or more elongated handle apertures 45 positioned along the inner periphery of the handle 40 or may comprise a similar configuration that provides an ample area for a consumer to grasp by inserting a hand through and still maintain the purpose and integrity of package.

While in the foregoing specification this invention has been described in relation to certain preferred embodiments thereof, and many details have been set forth for purpose of illustration, it will be apparent to those skilled in the art that the flexible carrier and multipackage are susceptible to additional embodiments and that certain of the details described herein can be varied considerably without departing from the basic principles of the invention.

The invention claimed is:

1. A flexible container carrier for unitizing a plurality of containers comprising:

a plurality of flexible bands that form an array of container receiving apertures, the array arranged in longitudinal rows and transverse ranks;

two handles, one respective handle of the two handles formed along each longitudinal edge of the array of container receiving apertures;

two or more center apertures formed within the plurality of flexible bands between the longitudinal rows of the container receiving apertures, wherein each center aperture is asymmetric relative to a transverse axis of the carrier and wherein each center aperture is within a central area of the carrier and elongated toward a center of the carrier;

two or more sets of perforations formed between each row of container receiving apertures; and a notch positioned within the plurality of flexible bands on each distal end of each center aperture, the notch generally longitudinally aligned with each set of perforations and configured to assist a blade to locate a center web of the carrier exactly where the carrier is to be cut.

2. The flexible carrier of claim 1 wherein the perforations comprise a plurality of slits positioned between each center aperture.

3. The flexible container carrier of claim 1 wherein a center band is approximately twice as wide as an outer band of the container carrier.

4. A flexible container carrier for unitizing a plurality of containers comprising:

a plurality of flexible bands that form two longitudinal rows of container receiving apertures, wherein the flexible bands in a center of the carrier are wider than the flexible bands along outer edges of the carrier;

two center apertures formed in the plurality of flexible bands between the two longitudinal rows of container receiving apertures, wherein each center aperture is asymmetric relative to a transverse axis of the carrier and wherein each center aperture is within a central area of the carrier and elongated toward a center of the carrier;

a set of perforations formed on each side of each center aperture;

a notch positioned within the plurality of flexible bands at each distal end of each center aperture, the notch generally longitudinally aligned with each set of perforations and configured to assist a blade to locate a center web exactly where the carrier is to be cut; and a handle formed along each longitudinal edge of the array of container receiving apertures.

5. The flexible carrier of claim 4 wherein the flexible bands in the center are approximately twice as wide as the flexible bands along the outer edges.

* * * * *